US011378072B2

(12) United States Patent
Okubo et al.

(10) Patent No.: US 11,378,072 B2
(45) Date of Patent: Jul. 5, 2022

(54) AIR COMPRESSOR

(71) Applicant: MAX CO., LTD., Tokyo (JP)

(72) Inventors: Shinichi Okubo, Tokyo (JP); Tsutomu Yoshida, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 16/845,776

(22) Filed: Apr. 10, 2020

(65) Prior Publication Data

US 2020/0325890 A1 Oct. 15, 2020

(51) Int. Cl.
*F04B 49/02* (2006.01)
*F04B 41/02* (2006.01)

(52) U.S. Cl.
CPC ..... *F04B 49/022* (2013.01); *F04B 41/02* (2013.01); *F04B 2203/0201* (2013.01); *F04B 2203/0207* (2013.01); *F04B 2203/0209* (2013.01); *F04B 2205/05* (2013.01); *F04B 2205/09* (2013.01)

(58) Field of Classification Search
CPC ..... F04B 2203/0201; F04B 2203/0207; F04B 2203/0209; F04B 49/022; F04B 41/02; F04B 2205/09; F04B 2205/05
See application file for complete search history.

(56) References Cited

U.S. PATENT DOCUMENTS 4,893,067 A * 1/1990 Bhagwat ..... H02P 7/2885 318/599
5,220,259 A * 6/1993 Werner ..... F04B 49/065 318/432
5,504,404 A 4/1996 Tamaki et al.
7,481,627 B2 * 1/2009 Beckman ..... F04B 41/02 173/2
10,465,677 B2 * 11/2019 Saukko ..... F04B 35/04
2004/0245949 A1 12/2004 Ueda et al.
2006/0045751 A1 * 3/2006 Beckman ..... F04B 49/022 417/44.2
2009/0097986 A1 * 4/2009 Nakata ..... F15B 11/0423 417/44.2

(Continued)

FOREIGN PATENT DOCUMENTS

JP 2003-239863 A 8/2003
JP 2004-085018 A 3/2004

(Continued)

OTHER PUBLICATIONS

The Extended European Search Report mailed in corresponding EP Patent Application No. 20169296.9 dated Jul. 17, 2020 (10 pages).

(Continued)

*Primary Examiner* — Christopher S Bobish
(74) *Attorney, Agent, or Firm* — Weihrouch IP

(57) ABSTRACT

An air compressor includes: a motor; a compression mechanism that is driven by the motor and that is configured to generate compressed air; a tank that is configured to store the generated compressed air; a load acquisition part that is configured to acquire a load applied to the compression mechanism; and a control part that is configured to control a rotation of the motor. The control part is configured to perform control for changing a TN characteristic of the motor in response to the load of the compression mechanism acquired by the load acquisition part.

10 Claims, 10 Drawing Sheets

(56) References Cited

U.S. PATENT DOCUMENTS

| | | | | |
|---|---|---|---|---|
| 2009/0108797 | A1* | 4/2009 | Haas | F04D 15/0066 318/801 |
| 2011/0196573 | A1* | 8/2011 | Lee | B60H 1/3222 701/36 |
| 2016/0245269 | A1 | 8/2016 | Nagata et al. | |
| 2016/0341191 | A1* | 11/2016 | Boeing | G05B 19/042 |
| 2017/0218964 | A1* | 8/2017 | Saukko | F04B 49/08 |
| 2020/0186073 | A1 | 6/2020 | Nigo et al. | |

FOREIGN PATENT DOCUMENTS

| | | | |
|---|---|---|---|
| JP | 2013-219969 | A | 10/2013 |
| JP | 2017-036692 | A | 2/2017 |
| WO | 2019-021374 | A1 | 1/2019 |

OTHER PUBLICATIONS

Nidec Corporation.: "TN Characteristics Nidec Corporation," Jul. 3, 2020 (Jul. 3, 2020), XP055711651, Retrieved from the Internet: URL: https://www.nidec.com/en/technology/motor/glossary/000/0617/[retrieved on Jul. 3, 2020].

Anonymous: "Field-Weakening Control (with MTPA) of PMSM—MATLAB & Simulink Example," Jul. 3, 2020 (Jul. 3, 2020), XP055711648, Retrieved from the Internet: URL: https://www.mathwoirks.com/help/mcb/gs/field-weakening-control-mtpa-pmsm.html.

* cited by examiner

AIR COMPRESSOR

CROSS-REFERENCE TO RELATED APPLICATIONS

This application is based upon and claims the benefit of priority from prior Japanese patent application No. 2019-076607, filed on Apr. 12, 2019, the entire contents of which are incorporated herein by reference.

TECHNICAL FIELD

The present invention relates to an air compressor that operates a compression mechanism by a motor.

BACKGROUND ART

While this type of air compressor is used by being connected to various machines, a working pressure (take-out pressure) and a consumption amount of compressed air are different depending on the machine to be used. For example, a spray gun that sprays paint by using the compressed air consumes a large amount of the compressed air because the spray gun is continuously used even though the working pressure is low.

When a machine that consumes a large amount of the compressed air is used as described above, an air compressor having a large discharge amount of the compressed air must be used. The reason is that for example, when the compressed air is not sufficient while using the spray gun, uneven painting of the painting is generated and thus a repainting work is required.

Therefore, in the machine that requires a large amount of the compressed air such as the spray gun, a large-type air compressor (for example, refer to JP-A-2003-239863) using an engine that discharges a large amount of the compressed air, can generate a larger amount of the compressed air than air to be consumed, and has a high filling speed is often used.

However, there is a problem with an engine-driven air compressor that is heavy and difficult to carry, has loud noise, and has a smell gasoline.

On the other hand, an air compressor in which a compression mechanism is operated by a motor (for example, refer to JP-A-2017-36692) is smaller and easier to carry than the engine-driven air compressor, and has less noise. When used at a location where there is no power source such as outdoor and a bridge, an engine-type generator can be used as the power source. However, since a power supply voltage is limited and a size of the motor is limited, there is a limit to an amount of compressed air that can be generated during the work. There is an air compressor that increases the amount of the compressed air that can be stored in a tank by increasing a pressure in the tank, but since a characteristic of the motor of the above-described air compressor is determined based upon a current value when the pressure in the tank reaches a high pressure, it cannot be said that the motor has a characteristic suitable for a case of a light load. Therefore, even though the air compressor is used for a machine such as a spray gun that uses a low air pressure, the generation of the compressed air cannot follow the use of the spray gun when the pressure in the tank becomes low, such that it is required to wait until the pressure in the tank becomes high and thus the workability is not good.

An object of the present invention is to allow a motor-driven air compressor to be used for a machine that requires a large amount of compressed air such as a spray gun by providing the motor-driven air compressor capable of increasing a discharge amount of the compressed air as compared with a related art.

SUMMARY OF INVENTION

According to an aspect of the present invention, there is provided an air compressor comprising: a motor; a compression mechanism that is driven by the motor and that is configured to generate compressed air; a tank that is configured to store the generated compressed air; a load acquisition part that is configured to acquire a load applied to the compression mechanism; and a control part that is configured to control a rotation of the motor, wherein the control part is configured to perform control for changing a TN characteristic of the motor in response to the load of the compression mechanism acquired by the load acquisition part.

BRIEF DESCRIPTION OF DRAWINGS

FIGS. 10A and 10B are diagrams according to a second modification, in which FIG. 10A is a plan view near an air outlet, and FIG. 10B is a side view near the air outlet; and FIGS. 11A and 11B are diagrams according to a third modification, in which FIG. 11A is a plan view near an air outlet, and FIG. 11B is a side view near the air outlet.

DESCRIPTION OF EMBODIMENTS

An embodiment of the present invention will be described with reference to the drawings.

Figure 1:
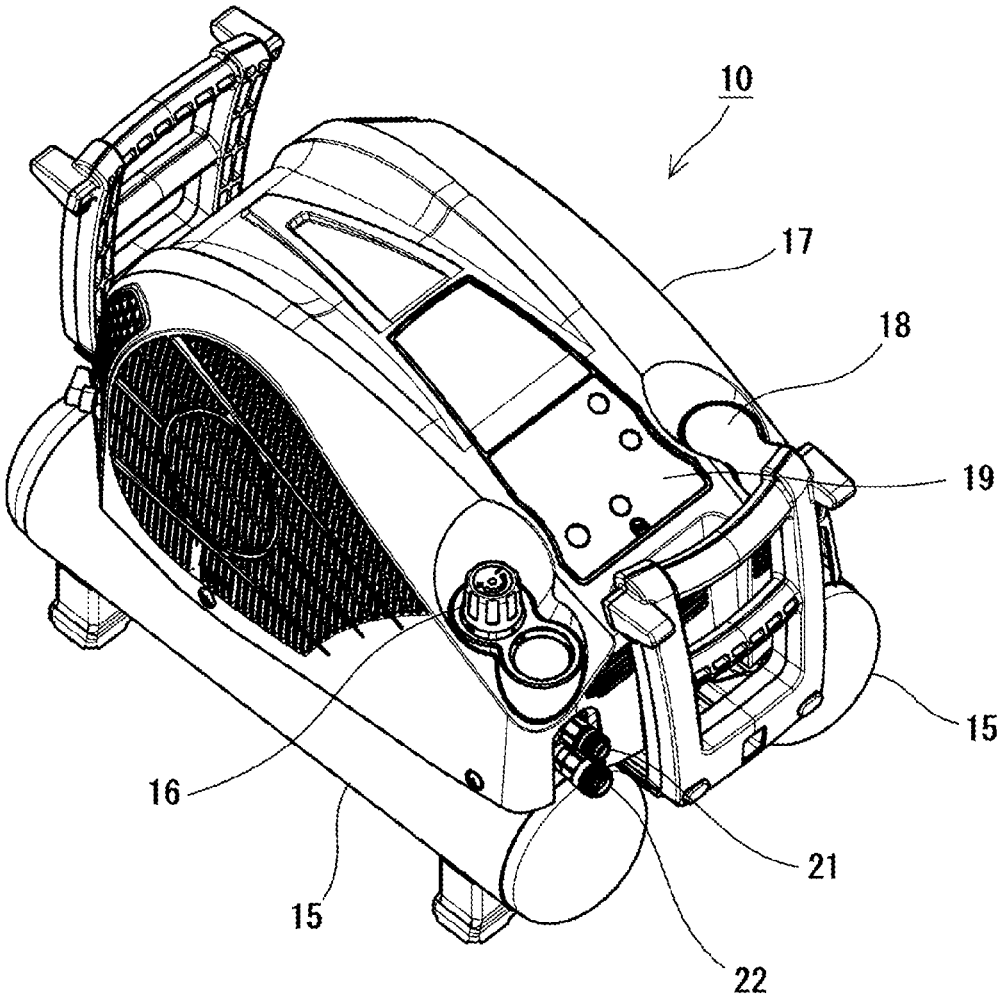
FIG. 1 is an external view of an air compressor.
Figure 2:
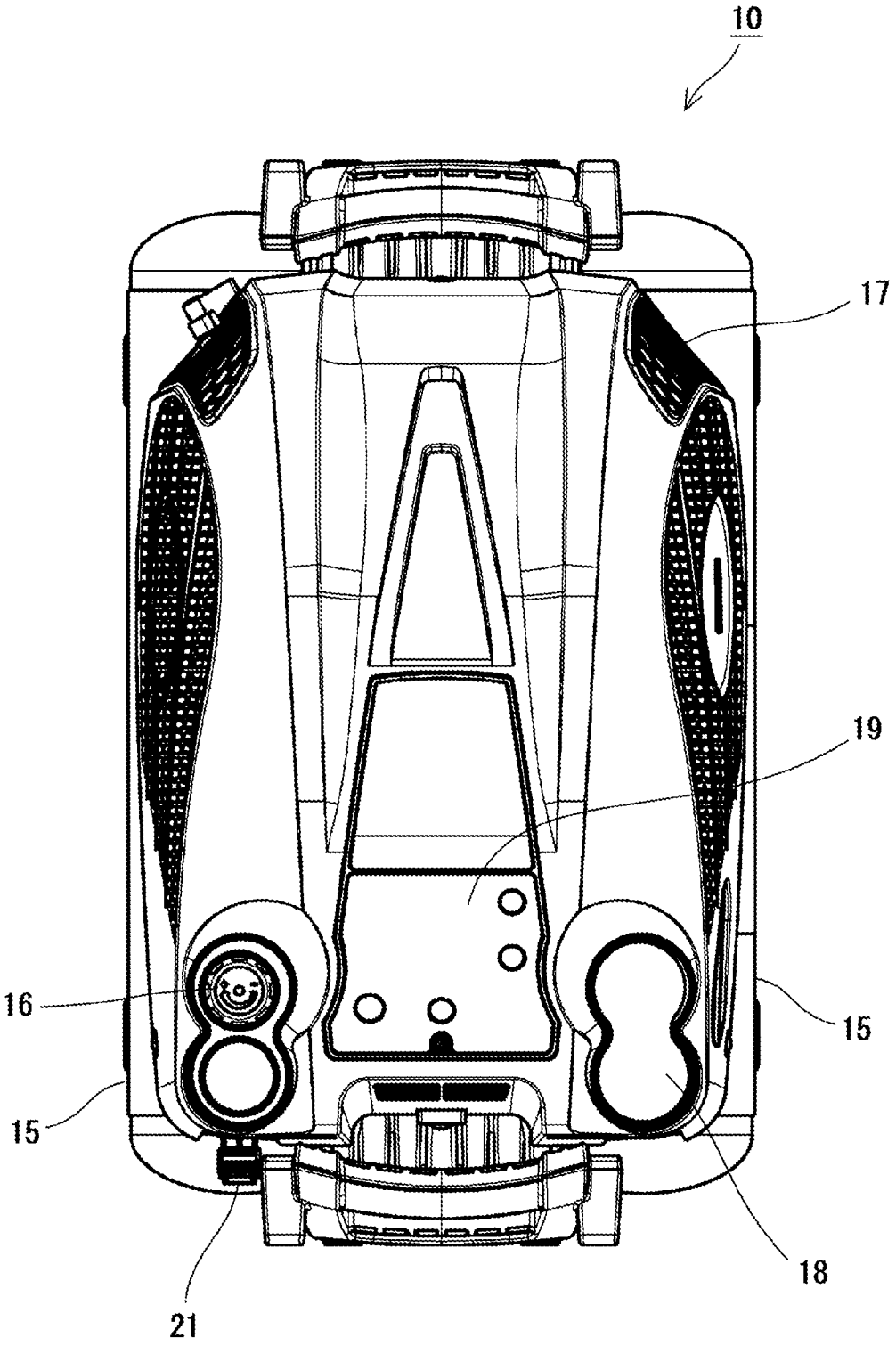
FIG. 2 is a plan view of the air compressor.

An air compressor 10 according to the embodiment is a portable compressor, and as illustrated in FIGS. 1 and 2, the air compressor 10 includes a mechanism part covered by a main body cover 17 and two tanks 15 disposed below the mechanism part.

Figure 3:
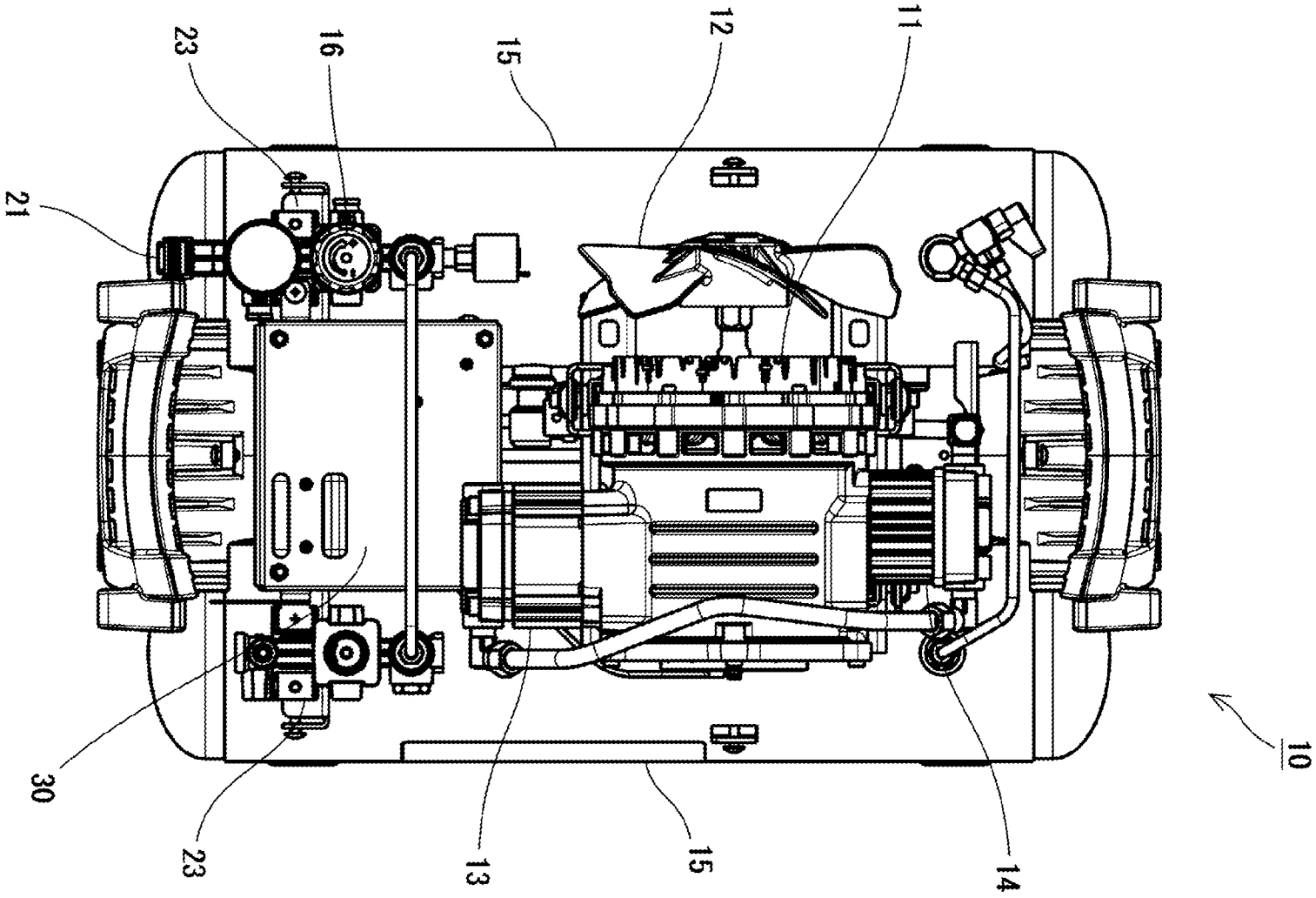
FIG. 3 is a plan view of the air compressor from which a main body cover is removed.

As illustrated in FIG. 3, the mechanism part includes a motor 11, a fan 12, a compression mechanism, and a control board (control part 30).

The motor 11 is an inner rotor type three-phase brushless DC motor in which a rotor is disposed inside an annular stator. The rotation of the motor 11 is controlled by a PWM signal outputted from the control part 30 which will be described later. The motor 11 includes a position sensor 36 and a thermistor 38 which will be described later. A current flowing through the motor 11 is supplied by converting an alternating current from an alternating current power source into a direct current. In the embodiment, an output of the air compressor 10 is 1.5 KW, and an upper limit of the alternating current supplied to the air compressor 10 is 15 A.

Therefore, the motor 11 is controlled by the alternating current before being converted into the direct current with 15 A as an upper limit value.

The fan 12 is provided for cooling a heat-generating component such as the motor 11 by introducing cooling air into the inside of the mechanism part. The fan 12 is fixed to a rotating shaft of the motor 11, and is configured to rotate integrally when the motor 11 is driven.

The compression mechanism is driven by the motor 11 to generate compressed air, and a well-known structure that compresses air introduced into a cylinder by reciprocating a piston can be used. The air compressor 10 according to the embodiment is a multi-stage compressor including two compression mechanisms of a primary compression mechanism 13 and a secondary compression mechanism 14. That is, the air supplied from the outside is first compressed by the primary compression mechanism 13. The air compressed by the primary compression mechanism 13 is introduced into the secondary compression mechanism 14, and is further compressed by the secondary compression mechanism 14. As described above, the air compressed with the two stages is sent to the tank 15 and stored.

The tank 15 is provided for storing the compressed air generated by the compression mechanism. The air compressor 10 according to the embodiment includes two tanks 15. The two tanks 15 are disposed in parallel to each other along a longitudinal direction of the air compressor 10.

The compressed air stored in the tank 15 is decompressed to any pressure by passing through a pressure reducing valve 16 and can be taken out to the outside from the air outlet. For example, the compressed air in the tank 15 can be supplied to an external device by connecting an air hose to which the external device such as a spray gun is connected to the air outlet.

Figure 4:
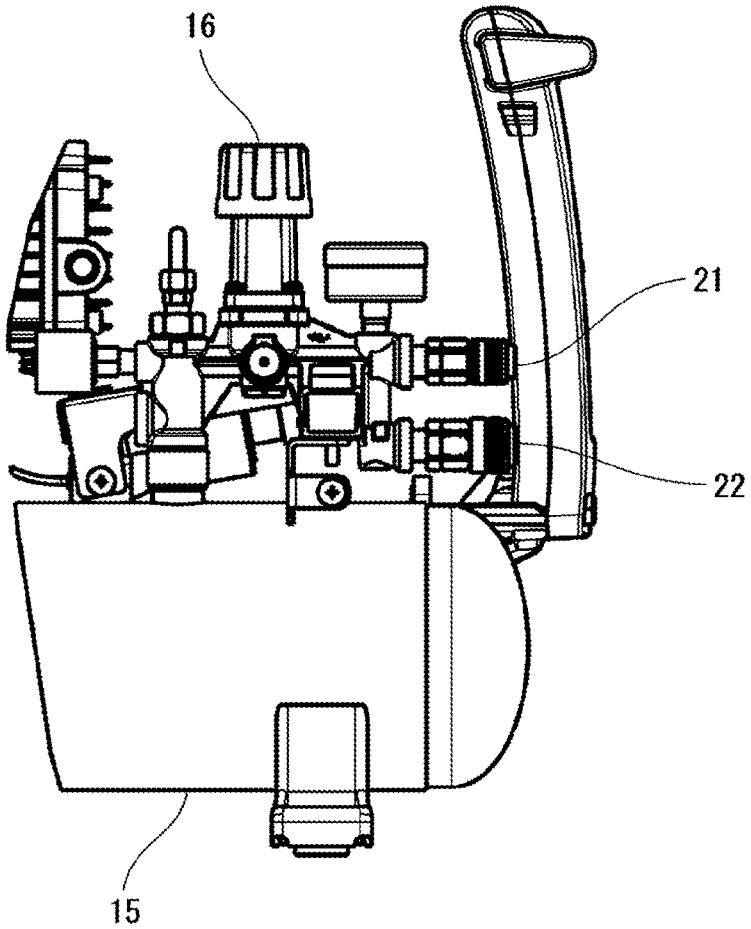
FIG. 4 is a side view near an air outlet of the air compressor from which the main body cover is removed.

In the embodiment, as illustrated in FIG. 4, two air couplers including a first air coupler 21 and a second air coupler 22 are vertically arranged as the air outlets. These air couplers are provided so as to protrude from the front of the main body cover 17 to the outside. The air coupler is a female coupler, and is configured to be easily attached and detached to and from corresponding male coupler. Therefore, the compressed air stored in the air compressor 10 can be configured to be taken out via the air hose by mounting the air hose mounted with the male coupler on the female coupler (the air outlet). For example, the first air coupler 21 is a coupler having a relatively small diameter corresponding to a device using a steady flow such as a spray, and the second air coupler 22 is a coupler for a large diameter hose suitable for the use of a device that consumes a large amount of the compressed air.

The first air coupler 21 is smaller and lighter than the second air coupler 22, and is used for connecting a small spray gun. On the other hand, for example, the second air coupler 22 is used for the connection of an additional tank used for increasing the compressed air to be stored. When the additional tank is connected, the capacity of the compressed air increases, and the time for continuous work can be extended. Since the additional tank is effective in separating the drain generated during the air compression, the additional tank is often used for painting work requiring dry compressed air. When a mist separator is connected, since it becomes possible to supply the compressed air suitable for the painting by separating moisture, oil, and dust contained in the compressed air, a coupler on which the mist separator can be mounted may be provided as the second air coupler 22. The second air coupler 22 connects a pneumatic tool such as a nailing machine, thereby making it possible to intermittently supply a large flow rate of the compressed air to the pneumatic tool.

At an architectural painting site, since a worker moves a lot and the feet of the worker are hooked on a hose drawn around the floor, there is a possibility that the air compressor 10 is unexpectedly pulled and falls down. Therefore, as illustrated in FIG. 3, the first air coupler 21 and the second air coupler 22 protrude along the longitudinal direction of the air compressor 10. In other words, the axial directions of the first air coupler 21 and the second air coupler 22 are arranged so as to be equal to the longitudinal direction of the tank 15. According to the above-described arrangement, even though the air hose connected to the air outlet is pulled, the air compressor 10 does not easily fall down.

As illustrated in FIG. 4, the first air coupler 21 and the second air coupler 22 are different in type and size. The second air coupler 22 larger than the first air coupler 21 is disposed below the first air coupler 21. According to the above-described arrangement, the center of gravity is lowered and thus the air compressor 10 is hard to fall down.

Here, in the embodiment, the insides of the two tanks 15 communicate with each other, and the above-described pressure reducing valve 16 and the air outlet (the first air coupler 21 and the second air coupler 22) are provided in one of the two tanks 15.

However, the invention is not limited thereto, and the pressure reducing valve 16 and the air outlet may be provided in both of the two tanks 15. In the embodiment, as illustrated in FIG. 3, a connection part 23 capable of connecting the pressure reducing valve 16 and the air outlet is provided in both of the two tanks 15. However, the number of components is reduced by providing the pressure reducing valve 16 and the air outlet only in one of the connection part 23.

The connection part 23 is disposed inside the main body cover 17. However, when the pressure reducing valve 16 and the air outlet are mounted on the connection part 23, the pressure reducing valve 16 and the air outlet are required to protrude to the outside of the main body cover 17. Therefore, in the main body cover 17, an opening part for allowing the pressure reducing valve 16 and the air outlet to protrude is formed at a position facing the connection part 23. The opening part is formed on both left and right sides respectively corresponding to the two connection parts 23.

In the embodiment, the opening part facing the unused connection part 23 is covered by the outlet cover 18 as illustrated in FIG. 2. The outlet cover 18 is attachable and detachable to and from the main body cover 17. When using the connection part 23 closed by the outlet cover 18, the outlet cover 18 may be detached therefrom, and the pressure reducing valve 16 and the air outlet may be mounted on the connection part 23.

The operation of the air compressor 10 is controlled by the control part 30 built in the air compressor 10. Although not illustrated herein, the control part 30 is mainly configured with a CPU, and includes a ROM, a RAM, and an I/O. The CPU is configured to control various input devices and output devices by reading a program stored in the ROM. In the embodiment, as illustrated in FIG. 3, the control part 30 is configured with a control board disposed above the tank 15.

Figure 5:
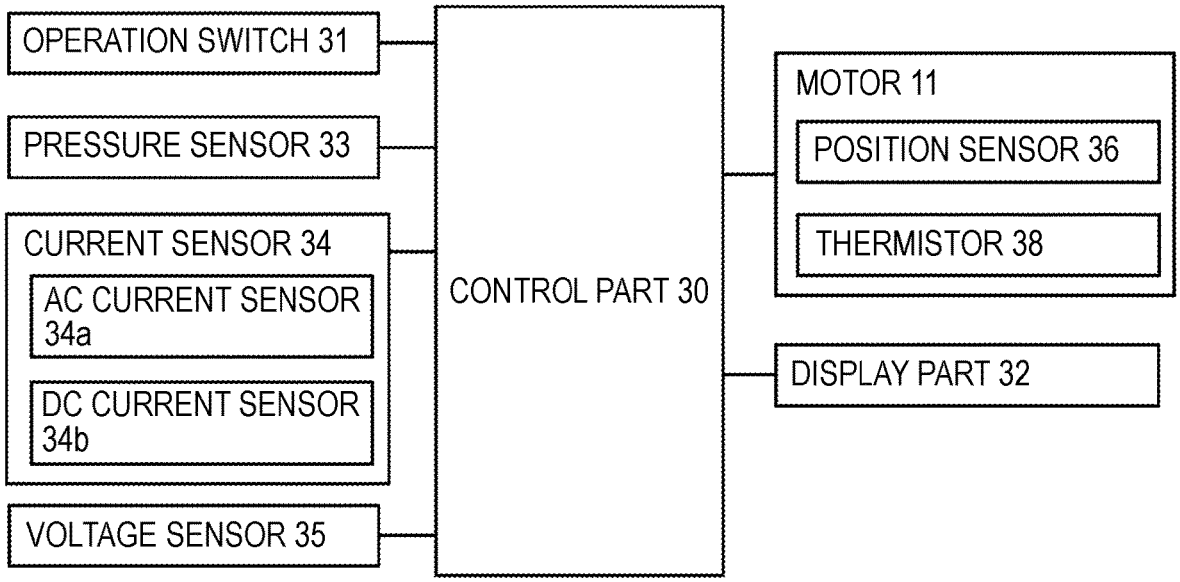
FIG. 5 is a block diagram illustrating an overview of a system of the air compressor.

As illustrated in FIG. 5, an operation switch 31, a pressure sensor 33, a current sensor 34, a voltage sensor 35, a position sensor 36, and a thermistor 38 are provided as the input devices of the control part 30. The input device is not limited to the above-mentioned input devices, and may include other input devices. Although details will be described later, in the embodiment, the pressure sensor 33, the current sensor 34, and the position sensor 36 function as a load acquisition part that acquires a driving load of the compression mechanism.

The operation switch 31 is various kinds of switches that can be operated by a user. Although not described in detail here, for example, a plurality of types of operation switches 31 such as a switch for turning on and off a power source and a switch for switching an operation mode may be provided. The operation switch 31 is disposed so as to be able to be pressed down on an operation panel 19 (refer to FIG. 1) provided on the surface of the main body cover 17.

The pressure sensor 33 is a tank internal pressure acquisition part that measures an internal pressure of the tank 15. A pressure value detected by the pressure sensor 33 is transmitted to the control part 30. The control part 30 controls the start or stop of the driving of the motor 11 based upon the pressure value acquired from the pressure sensor 33. Specifically, an ON pressure which is a pressure value for starting the driving of the compression mechanism and an OFF pressure which is a pressure value for stopping the driving of the compression mechanism are predetermined, and for example, when the internal pressure of the tank 15 is lowered due to the use of the compressed air and the internal pressure of the tank 15 is lowered up to the preset ON pressure, the motor 11 is driven to fill the compressed air. When the internal pressure of the tank 15 reaches the preset OFF pressure while the motor 11 is being driven, the driving of the motor 11 is stopped.

The current sensor 34 is configured with an AC current sensor 34*a* that detects the alternating current from the alternating current power source serving as a power source of the air compressor 10, and a DC current sensor 34*b* that detects the direct current supplied to the motor 11. The AC current sensor 34*a* is provided for detecting the alternating current flowing from the alternating current power source to the air compressor 10, and is used for performing monitoring so that the current flowing through the air compressor 10 does not exceed 15 A of an upper limit value. The DC current sensor 34*b* is provided for detecting a three-phase current value supplied to the motor 11. The detection value of the DC current sensor 34*b* is transmitted to the control part 30, and is used for the purpose of monitoring field weakening control which will be described later and the direct current flowing through an electronic component. The current sensor 34 functions as a motor load detection part that detects a load of the motor 11.

Figure 8:
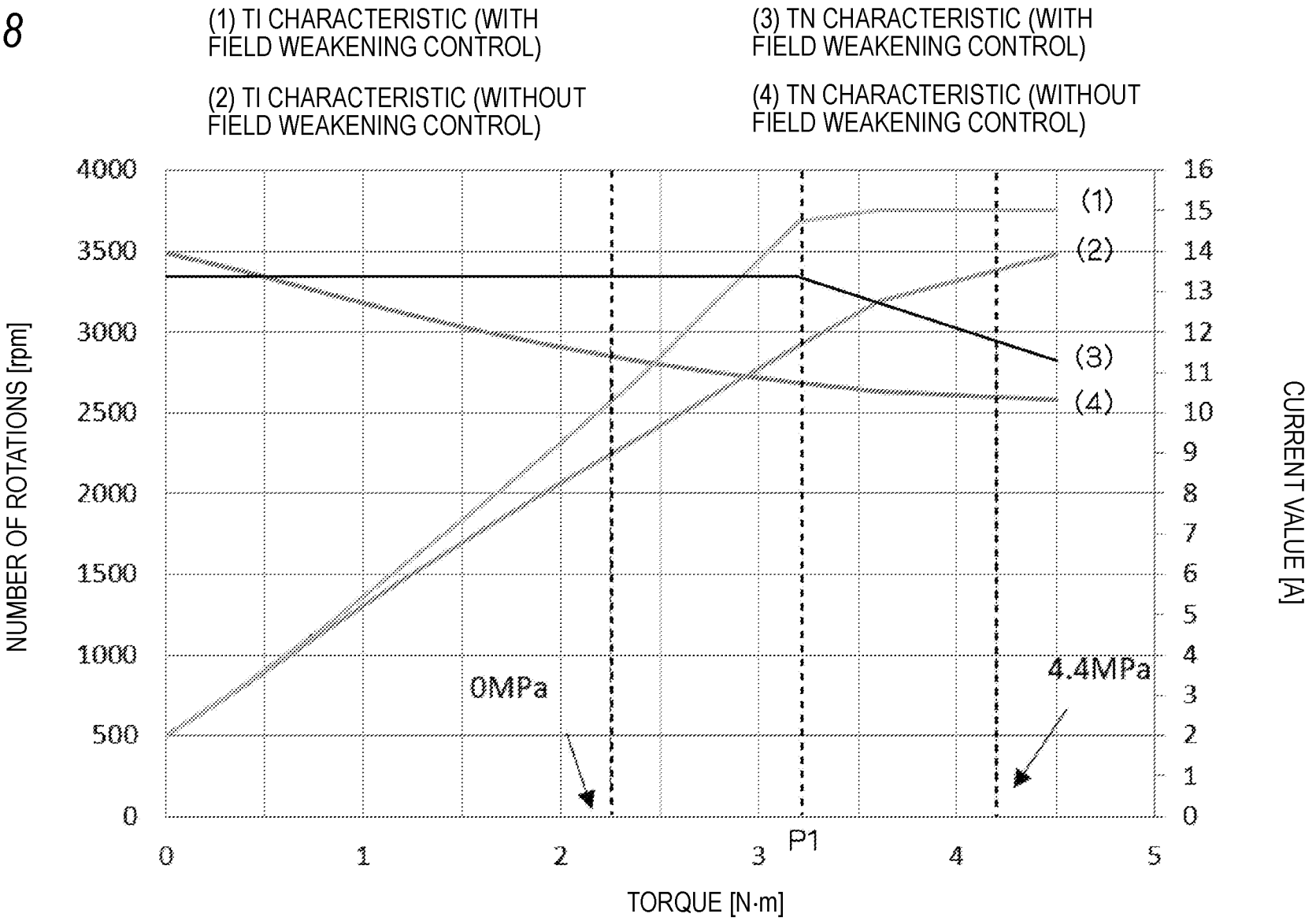
FIG. 8 is a diagram illustrating a change in a motor characteristic due to the field weakening control.

That is, as a general characteristic of the motor 11, the current value also gradually increases as the torque increases (refer to (2) in FIG. 8). In a case where the motor 11 is incorporated in the air compressor 10, since the torque of the motor 11 increases when the internal pressure of the tank 15 becomes high, the torque, that is, the internal pressure of the tank 15 can be estimated by referring to the current value of the DC current sensor 34*b*. As a specific method of estimating the internal pressure of the tank 15, for example, a method, in which a conversion table indicating a relationship between the current value of the DC current sensor 34*b* and the internal pressure of the tank 15 is stored in advance in the ROM, and the current value of the DC current sensor 34*b* is converted into the internal pressure of the tank 15 by using this conversion table, may be used. As another method of estimating the internal pressure of the tank 15, a method, in which a calculation formula for converting the current value of the DC current sensor 34*b* into the internal pressure of the tank 15 is generated in advance, and the internal pressure of the tank 15 is estimated by substituting the current value of the DC current sensor 34*b* for this calculation formula, may be used. When the above-described conversion table and calculation formula are used, the DC current sensor 34*b* and the control part 30 function as the tank internal pressure acquisition part that acquires the internal pressure of the tank 15.

The voltage sensor 35 is provided for detecting a primary side voltage value supplied to the motor 11. The detection value of the voltage sensor 35 is transmitted to the control part 30 and used for the field weakening control which will be described later.

The position sensor 36 is provided for detecting a rotational position of the motor 11. The position sensor 36 is configured with a Hall IC, and is configured to output a signal to the control part 30 when the rotation of the motor 11 (a rotor) is detected. The control part 30 can calculate the number of rotations (rpm) of the motor 11 by analyzing the signal from the position sensor 36.

The thermistor 38 is provided for detecting a temperature of the motor 11. The temperature detected by the thermistor 38 is used for correcting the control of the motor 11.

The motor 11 detects a rotation angle of the motor 11 from winding resistance. The thermistor 38 may detect a temperature change in the winding resistance of the motor 11 and may correct the detection of the rotation angle of the motor 11 based upon the detected temperature change.

As illustrated in FIG. 5, the motor 11 and a display part 32 are provided as output devices of the control part 30. The output device is not limited thereto, and may include other output devices.

The motor 11 serves as a power source for operating the compression mechanism as described above. The control part 30 controls the rotation of the motor 11 by PWM control.

A display part 32 is provided for displaying various information to the user. For example, there are display devices such as a 7-segment display, a liquid crystal screen, and an LED. The display part 32 according to the embodiment is provided on the operation panel 19 provided on the surface of the main body cover 17.

Here, the control part 30 according to the embodiment is configured to perform control for changing the TN characteristic of the motor 11 in response to the internal pressure of the tank 15. Specifically, the control part 30 is configured to change the TN characteristic of the motor 11 by the field weakening control.

In the motor-driven air compressor 10 of the related art, since the TN characteristic of the motor 11 is determined, there is a limit to increasing the number of rotations. In consideration of this point, when the TN characteristic of the motor 11 is changed in response to the internal pressure of the tank 15 (in response to the torque), the number of rotations of the motor 11 can be increased beyond an original characteristic of the motor 11.

Accordingly, the number of rotations of the motor 11 can be increased at the time of a low load, thereby making it possible to increase the discharge amount of the compressed air. For example, when the spray gun is connected to the air compressor 10 and used, the internal pressure of the tank 15 is lowered when the remaining compressed air decreases. When the internal pressure of the tank 15 is lowered in this manner, the number of rotations of the motor 11 is increased, thereby making it possible to shorten the filling time of the compressed air by changing the TN characteristic of the motor 11 in accordance with the lowness of the internal pressure thereof. Next, when the compressed air is filled and the internal pressure of the tank 15 increases, the TN characteristic of the motor 11 is restored (returned to the original characteristic) in accordance with the increase of the internal pressure thereof, such that the motor 11 can be driven with optimum efficiency. Therefore, when the internal pressure of the tank 15 is low and the load is low, the number of rotations is increased to improve the discharge amount, and when the internal pressure of the tank 15 is high and the load is high, performance can be maintained by efficiently driving the motor 11.

Figure 6:
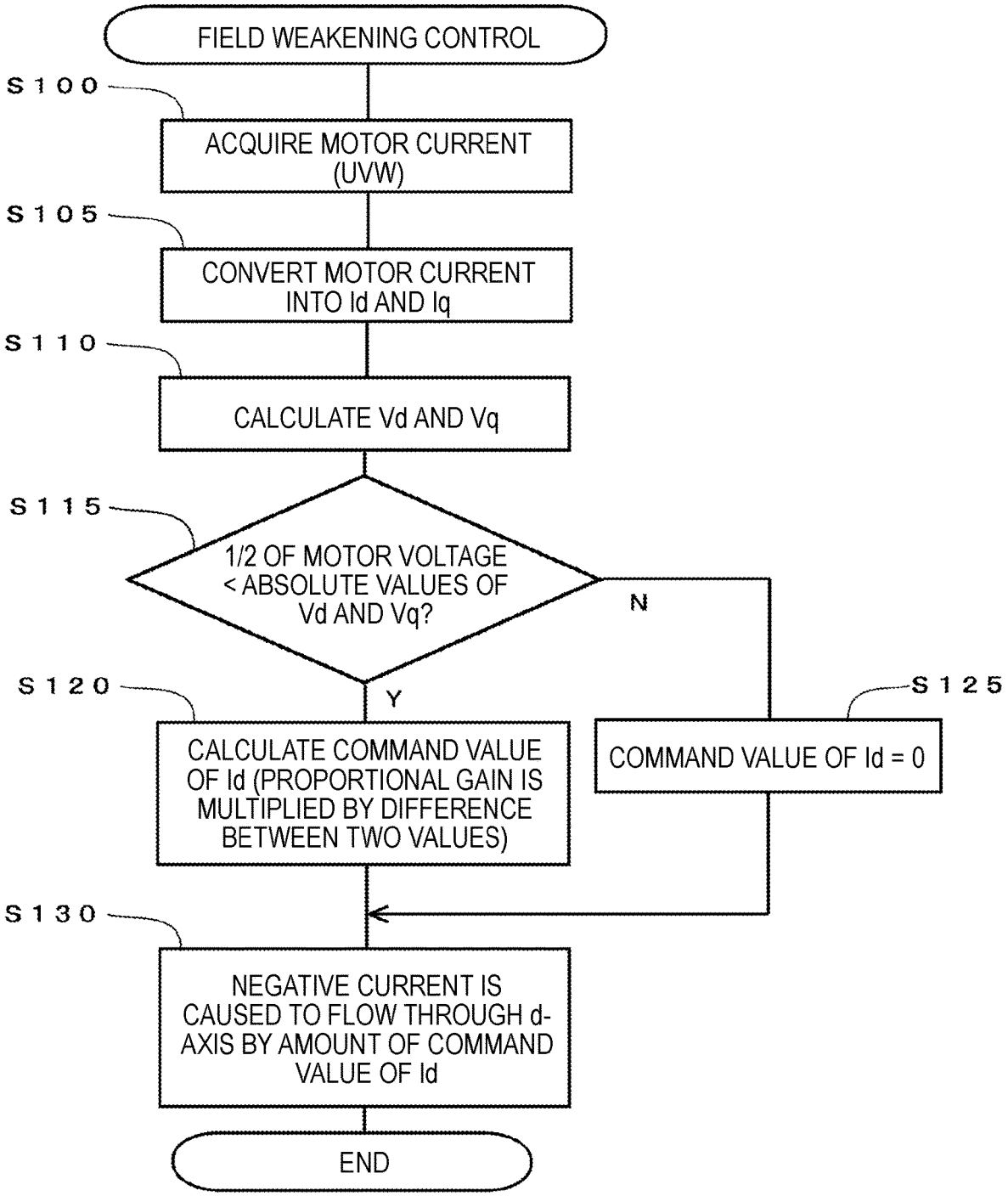
FIG. 6 is a flowchart of field weakening control.

This field weakening control is executed by the control part 30 according to a flow of a process as illustrated in FIG. 6. The process illustrated in FIG. 6 is executed every fixed time by being registered in a periodic handler. In the embodiment, the process illustrated in FIG. 6 is executed every 125 μs.

First, in step S100 illustrated in FIG. 6, a supply current to the motor 11 is acquired as the load of the motor 11 by using the DC current sensor 34*b*. Next, the process proceeds to step S105.

In step S105, a current value acquired in step S100 is subjected to dq conversion, thereby acquiring a d-axis current value Id and a q-axis current value Iq of a rotation coordinate system. Next, the process proceeds to step S110.

In step S110, a d-axis voltage value Vd and a q-axis voltage value Vq are calculated based upon Id and Iq acquired in step S105. Next, the process proceeds to step S115.

In step S115, a half of the supply voltage value to the motor 11 acquired by using the voltage sensor 35 is compared with absolute values of Vd and Vq calculated in step S110. When the latter is greater, the process proceeds to step S120. Otherwise, the process proceeds to step S125.

When the process proceeds to step S120, a command value of Id is calculated. Specifically, the command value of Id is calculated by multiplying a value obtained by subtracting the absolute values of Vd and Vq from the supply voltage value to the motor 11 by a predetermined proportional gain. The command value of the Id is a negative value. Next, the process proceeds to step S130.

When the process proceeds to step S125, 0 is set to the command value of Id. Next, the process proceeds to step S130.

In step S130, the field weakening control is executed by using the command value of Id. That is, a negative current is caused to flow through the d-axis by an amount of the command value of Id, whereby control for shifting an advance angle of the motor 11 in an advance direction is executed. However, when the command value of Id is 0, the field weakening control is not executed.

At this time, the command value of Iq is actually set with reference to various parameters, a voltage command value is calculated based upon the command value of Id and the command value of Iq, and the PWM control is executed by using a value obtained by converting the voltage command value into three phases of UVW.

When determining an output of the PWM, feedback control is executed so that the number of rotations of the motor 11 and the current value do not exceed a predetermined upper limit value. In the embodiment, the upper limit value of the number of rotations of the motor 11 is set to 3400 rpm, and the output is controlled so as not to exceed the upper limit value. In the embodiment, the upper limit value of the alternating current is set to 15 A, and the output is controlled so as not to exceed the upper limit value by detecting the current value with the AC current sensor 34*a*.

Figure 7:
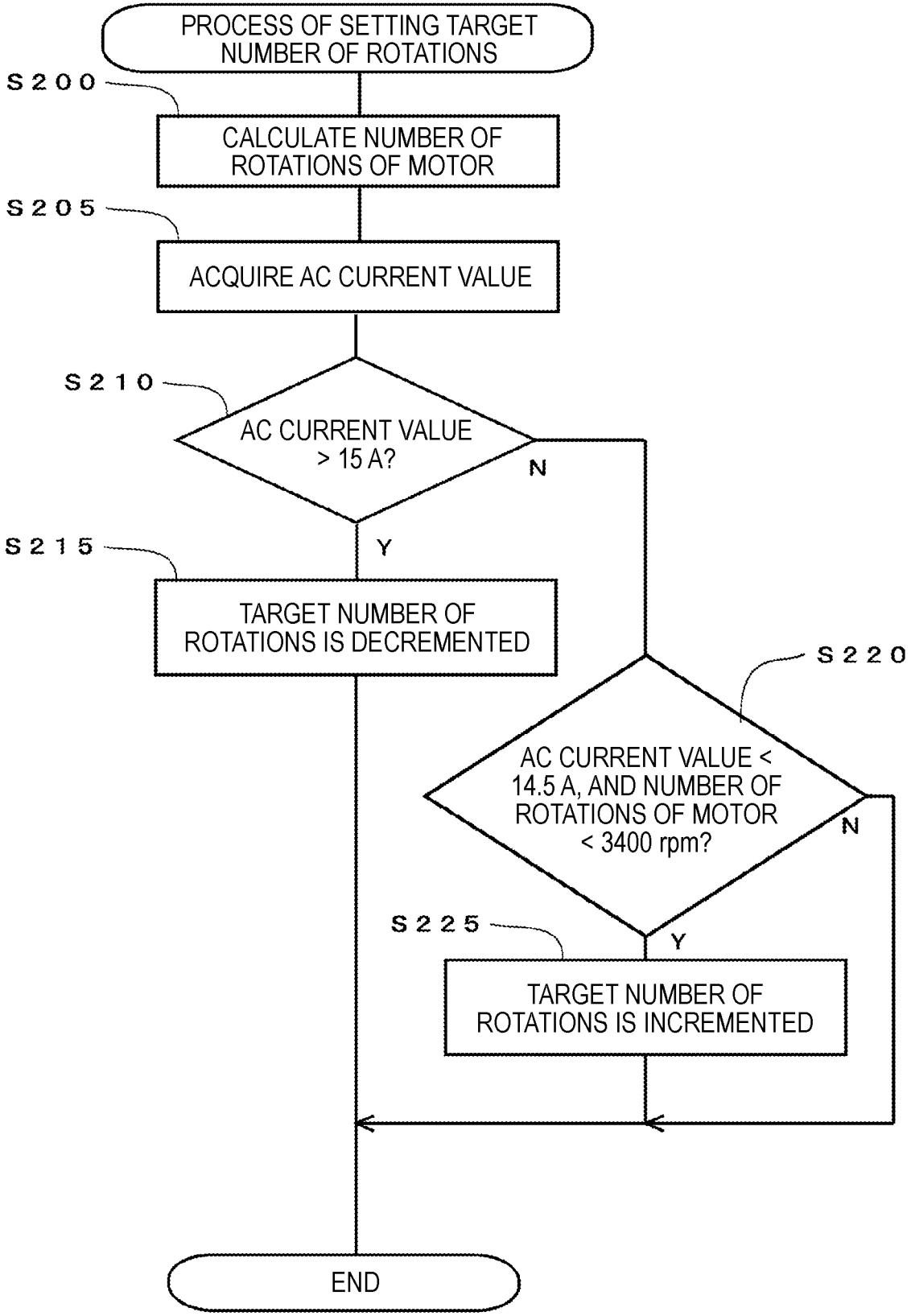
FIG. 7 is a flowchart of a process of setting the target number of rotations.

Specifically, a process of setting the target number of rotations as illustrated in FIG. 7 is executed. The process illustrated in FIG. 7 is executed every fixed time by being registered in the periodic handler. In the embodiment, the process illustrated in FIG. 7 is executed every 40 ms.

First, in step S200 illustrated in FIG. 7, the number of rotations of the motor 11 is calculated. The number of rotations of the motor 11 can be calculated from the number of detections of the position sensor 36 in fixed time. After calculating the number of rotations of the motor 11, the process proceeds to step S205.

In step S205, a direct current value is acquired by using the AC current sensor 34*a*. Next, the process proceeds to step S210.

In step S210, it is performed to check whether or not the direct current value exceeds the upper limit value (15 A). When the direct current value exceeds 15 A, the process proceeds to step S215. On the other hand, when the direct current value is equal to or less than 15 A, the process proceeds to step S220.

When the process proceeds to step S215, the target number of rotations of the motor 11 is reduced by a predetermined amount. Accordingly, in the subsequent control of the motor 11, control aiming at rotation at the target number of rotations is executed. Next, the process of setting the target number of rotations is terminated.

When the process proceeds to step S220, it is performed to check whether the direct current value is not near the upper limit value (equal to or greater than 14.5 A) and the number of rotations of the motor 11 calculated in step S200 is less than the upper limit value (3400 rpm). When the direct current value is less than 14.5 A and the number of rotations of the motor 11 is less than 3400 rpm, the process proceeds to step S225. Otherwise, the process of setting the target number of rotations is terminated.

When the process proceeds to step S225, the target number of rotations of the motor 11 increases by a predetermined amount. Accordingly, in the subsequent control of the motor 11, control aiming at rotation at the target number of rotations is executed. Next, the process of setting the target number of rotations is terminated.

According to the control described above, the target number of rotations is set as high as possible within a range where the alternating current does not exceed 15 A which is the upper limit value.

As can be seen with reference to (1) in FIG. 8, in the motor 11 of the embodiment, when the field weakening control is performed, the motor torque reaches 15 A of the upper limit value of the alternating current in the vicinity of 3 N·m (P1). Accordingly, when the torque exceeds P1, it is not possible to perform the control of the number of rotations of the motor 11 by controlling the current value. However, in a torque region smaller than P1, since there is a margin until the motor torque reaches 15 A of the upper limit value of the alternating current, the field weakening control is performed by using the marginal current.

By performing the field weakening control as described above, the TN characteristic of the motor 11 is changed in response to the internal pressure of the tank 15, and the number of rotations can be increased.

Under the above-described control, the motor 11 shows the characteristics as shown in FIG. 8. FIG. 8 is a graph showing a TI characteristic (a characteristic indicating a relationship between the torque and the current) and a TN characteristic (a characteristic indicating a relationship between the torque and the number of rotations) of the motor 11; (1) shows the TI characteristic with the field weakening control; (2) shows the TI characteristic without the field weakening control; (3) shows the TN characteristic with the field weakening control; and (4) shows the TN characteristic without the field weakening control. In FIG. 8, when the motor 11 is incorporated in the air compressor 10, the internal pressure (gauge pressure) of the tank 15 corresponding to the torque generated in the motor 11 is shown with a vertical line indicating 0 MPa and a vertical line indicating 4.4 MPa.

In the field weakening control according to the embodiment, the current value of the motor 11 is acquired (refer to step S100 in FIG. 6), and the internal pressure of the tank 15 is estimated based upon the acquired current value thereof. As the current value of the motor 11 increases (as the internal pressure of the tank 15 becomes high), the field weakening is configured to gradually become stronger (a degree of advancing an advance angle of the motor 11 becomes stronger). That is, the amount of decrease in the number of rotations according to the TN characteristic of the motor 11 is configured to increase so as to be stabilized at a fixed rotation (3,400 rpm in the embodiment) by the field weakening control.

As illustrated in (3), by performing the field weakening in this manner, the number of rotations of the motor 11 can be increased beyond the original characteristic of the motor 11 (refer to (4)). However, in the embodiment, since the number of rotations is controlled to be stabilized at 3400 rpm, the number of rotations is not increased beyond the original characteristic thereof. As the number of rotations increases, the current value increases more than the original characteristic of the motor 11, but since the upper limit of the current value of the air compressor 10 of the embodiment is 15 A, control is performed so as not to exceed 15 A (refer to (1)). After reaching 15 A of the upper limit of the current value (a region where the torque is higher than P1), as illustrated in (3), control is performed to reduce the number of rotations of the motor 11 so as to approach the number of rotations indicated by the original TN characteristic of (4). In other words, the control is performed so as to gradually reduce the number of rotations of the motor 11, whereby the current value is maintained at 15 A even when the load increases.

In the embodiment, when the internal pressure of the tank 15 becomes about 0.8 MPa (refer to P1), it is set to reach 15 A of the upper limit value of the current. That is, when the internal pressure of the tank 15 becomes about 0.8 MPa, the control of the motor 11 is configured to be changed.

Specifically, when the torque becomes higher than the line indicated by P1 in FIG. 8, the current reaches 15 A of the upper limit of the current. As described above, when the torque is higher than P1 (when the internal pressure of the tank 15 is higher than a predetermined value), the motor 11 is controlled so as to weaken the field weakening as the torque increases. On the other hand, when the torque is lower than P1 (when the internal pressure of the tank 15 is lower than the predetermined value), the motor 11 is controlled so as to strengthen the field weakening as the torque increases.

In the embodiment, the internal pressure (P1) of the tank 15 at which the control is switched is set to 0.8 MPa, and this setting is not limited to 0.8 MPa. However, it is desirable that the internal pressure of the tank 15 is set to reach 15 A in the range of 0.5 MPa to 1.5 MPa as a low load pressure zone.

As described above, the control part 30 according to the embodiment performs the control to change the TN characteristic of the motor 11 in response to the internal pressure of the tank 15. According to such control, since the number of rotations of the motor 11 can be increased in accordance with the internal pressure of the tank 15, the discharge amount of the compressed air can be increased even in the case of a small motor 11 driven air compressor 10.

In the embodiment, the internal pressure of the tank 15 is estimated from the direct current flowing through the motor 11 detected by the DC current sensor 34*b*, and it is also possible to estimate the internal pressure of the tank 15 from the alternating current flowing through the air compressor 10 detected by the AC current sensor 34*a*. The internal pressure of the tank 15 may be directly acquired by using the pressure sensor 33. Instead of using the current sensor 34, the number of rotations of the motor 11 may be detected by using the position sensor 36, thereby estimating the driving load of the air compressor 10 based upon the detected number of rotations thereof.

(First Modification)

A first modification is configured in such a manner that control is performed by switching between a normal mode and a following mode with reference to the internal pressure (the torque) of the tank 15, and the mode is switched by a method different from the above-described embodiment.

The air compressor 10 according to the first modification includes: a normal mode in which the TN characteristic of the motor 11 is kept constant regardless of the internal pressure of the tank 15; and a following mode in which the TN characteristic of the motor 11 is changed in response to the internal pressure of the tank 15.

Of the normal mode and the following mode, the normal mode is a control mode without the field weakening control (or a control mode in which an advance angle control is constant). In a pressure zone to which the normal mode is applied, since the TN characteristic of the motor 11 is kept constant, the TN characteristic of the motor 11 is not changed even though the internal pressure (the torque) of the tank 15 is varied.

On the other hand, the following mode is a control mode with the field weakening control (or a control mode in which the advance angle control is varied). In a pressure zone to which the following mode is applied, the TN characteristic of the motor 11 is changed in response to the internal pressure (the torque) of the tank 15. A method of changing the TN characteristic is the same as that of the above-described embodiment, and the advance angle may be adjusted in accordance with the current value of the motor 11.

Figure 9:
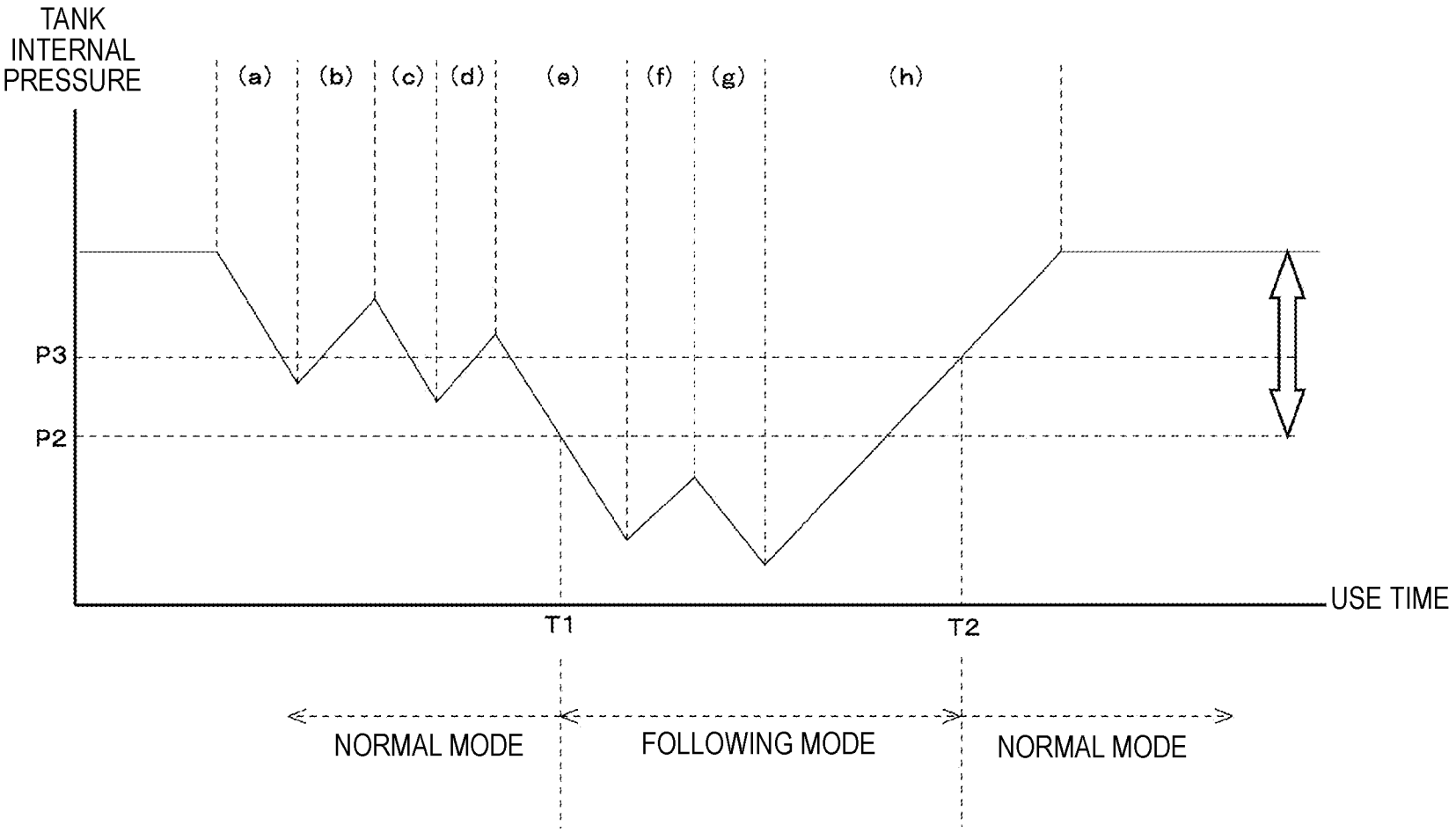
FIG. 9 is a diagram according to a first modification, and is a diagram illustrating the timing of mode switching.

FIG. 9 is a diagram illustrating a change in the internal pressure of the tank 15 when the spray gun is connected to the air compressor 10 according to the first modification and used. As illustrated in regions (a), (c), (e), and (g) in FIG. 9, when the spray gun is used, the compressed air is consumed and the internal pressure of the tank 15 is lowered. As illustrated in regions (b), (d), (f), and (h) in FIG. 9, when the compressed air is consumed to some extent and the internal pressure of the tank 15 is lowered up to the ON pressure, the compression mechanism is driven, such that the internal pressure of the tank 15 increases when the use of the spray gun is interrupted. However, since the internal pressure of the tank 15 is gradually lowered due to the intermittent use of the spray gun, finally, the compressed air may be not sufficient.

At this time, when the remaining amount of the compressed air decreases and the internal pressure of the tank 15 is lowered, the torque of the motor 11 is lowered, thereby making it possible to increase the number of rotations. However, when using the motor 11 optimized for a high load zone, there is a limit even though the number of rotations of the motor 11 increases in a low load zone, due to the characteristic of the motor 11.

Therefore, in the modification, the number of rotations of the motor 11 can be increased by performing the field weakening control in the low load zone.

Specifically, in the modification, when the internal pressure of the tank 15 is higher than a predetermined level (refer to P2 in FIG. 9), efficient control is performed by utilizing the original characteristic of the motor 11 (without performing the field weakening control). On the other hand, when the internal pressure of the tank 15 is lowered below the predetermined level (P2), the control for increasing the number of rotations of the motor 11 is performed by performing the field weakening control. Accordingly, as illustrated in FIG. 9, in a state before the internal pressure of the tank 15 is lowered up to P2, the control is executed in the normal mode, and when the internal pressure of the tank 15 is lowered below P2, the control is executed in the following mode. The predetermined level (P2) is a pressure higher than 0.3 to 0.5 MPa which is the working pressure of the spray gun, and for example, is set to 1 MPa. The reason is that since the compressed air cannot be generated in time when the field weakening control is performed after the internal pressure of the tank 15 is lowered to the working pressure of the spray gun, a margin is provided to prevent the compressed air from running short.

When the internal pressure of the tank 15 becomes higher than a predetermined level (P3) when the field weakening control is performed as described above, the field weakening control is terminated, and the control is configured to be switched from the following mode to the normal mode. This P3 is set higher than P2, and set to, for example, 1.5 MPa. Since the internal pressure of the tank 15 gradually is lowered during the use of the spray gun, it can be estimated that the use of the spray gun is stopped in consideration the fact that P3 higher than P2 is detected. In other words, when it is estimated that the use of the spray gun is stopped, the mode is configured to be switched from the following mode to the normal mode in which efficiency is emphasized.

As described in the example of FIG. 9, when the compressed air is used and the internal pressure of the tank 15 is lowered beyond P2 as illustrated in the region (e), the control is switched at the timing (T1) exceeding P2. Accordingly, the field weakening control is executed, and the control for increasing the number of rotations is executed.

Then, when the compressed air is filled and the internal pressure of the tank 15 becomes higher than P3 as illustrated in the region (h), the control is switched to the normal mode at the timing (T2) exceeding P3. Accordingly, the field weakening control is released, and the control in which efficiency is emphasized is executed.

As a method of acquiring the internal pressure of the tank 15, as described above, the method of estimating the internal pressure of the tank 15 from the current value of the motor 11 may be used, or the method of directly detecting the internal pressure of the tank 15 with the pressure sensor 33 may be used. The load of the air compressor 10 may be detected by detecting the number of rotations of the motor 11 by using the position sensor 36.

The pressure values P2 and P3 to be used for switching the mode may be fixed values or variable values. When P2 and P3 are varied, P2 and P3 may be varied in response to a used amount of the compressed air. For example, the value of P2 may be set to be high when the used amount of the compressed air is large by calculating the used amount of the compressed air from the detected value of the pressure sensor 33. The values of P2 and P3 may be set to any values by a user using the operation panel 19. According to the above-described configuration, the user can select any control in response to the tool (the spray gun) to be used and the amount of work.

According to the above-described configuration, even when the motor 11 optimized for the high load zone is used to quickly fill the tank 15 with high pressure air, the number of rotations in the low load zone can be increased, and even when the spray gun using low-pressure compressed air is used, air shortage is hardly generated.

Second Embodiment

Figure 10A:
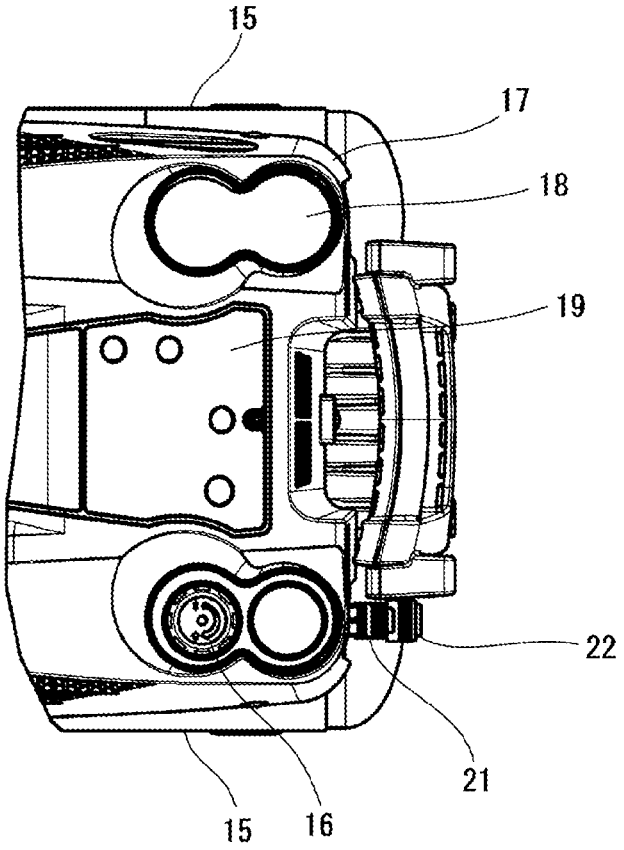
Figure 10B:
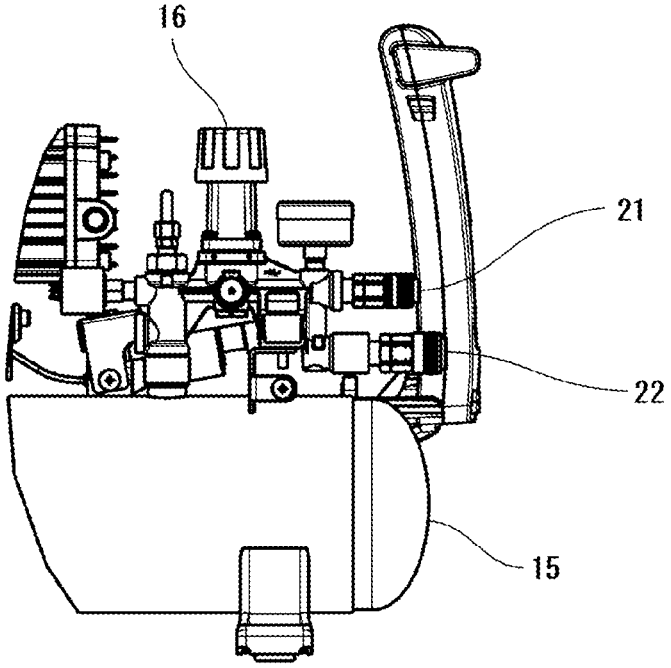

As illustrated in FIGS. 10A and 10B, the first air coupler 21 and the second air coupler 22 may have different lengths (protrusion amounts). For example, the second air coupler 22 larger than the first air coupler 21 may be disposed below the first air coupler 21, and may protrude larger than the first air coupler 21. According to the above-described configuration, since the air compressor 10 is hard to fall down, and further the connection position between the first air coupler 21 and the second air coupler 22 is offset, the air hose can be easily attached and detached.

Third Embodiment

Figure 11A:
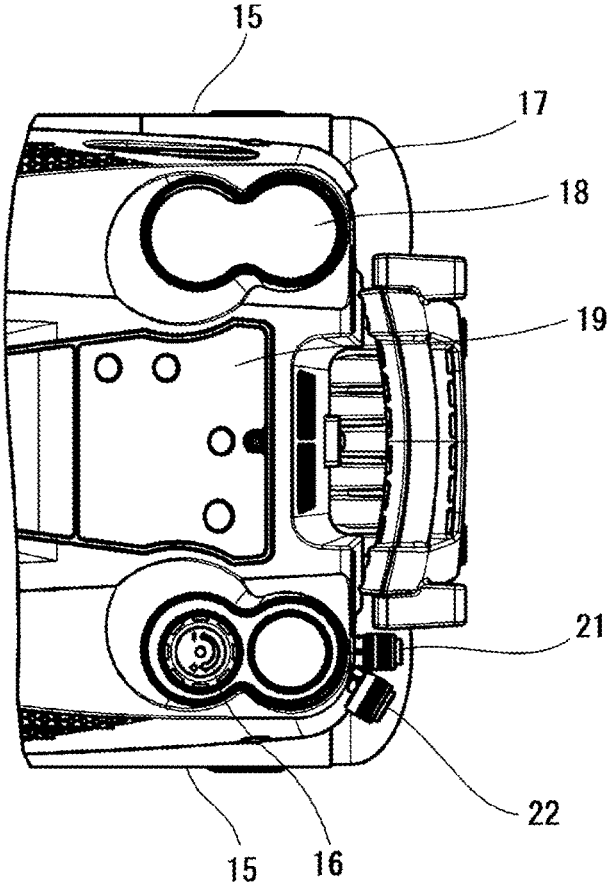
Figure 11B:
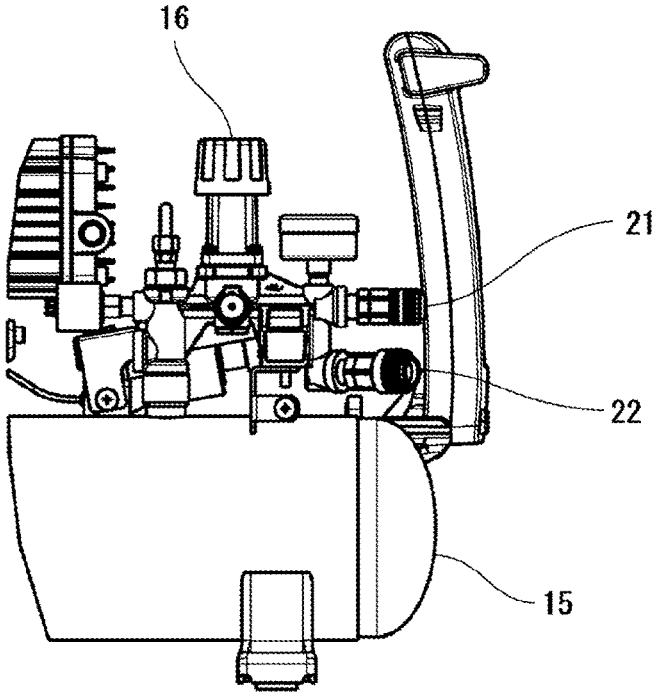

As illustrated in FIGS. 11A and 11B, the first air coupler 21 and the second air coupler 22 may be provided so as to have different axial directions. For example, an acute angle may be formed in the axial direction of the first air coupler 21 and in the axial direction of the second air coupler 22. According to the above-described configuration, since the connection position between the first air coupler 21 and the second air coupler 22 is offset, the air hose can be easily attached and detached.

Fourth Embodiment

When detecting a fact that the internal pressure of the tank 15 is lowered below a predetermined value, the air compressor 10 may include a notification part for notifying the fact. As an example of the notification part, notification by voice from a speaker 37 or display on the display part 32 may be used. A solenoid valve for opening and closing a passage is provided in the passage for taking out the compressed air of the compression mechanism (for example, on the downstream side of the pressure reducing valve or the upstream side of the air coupler), and when the internal pressure of the tank 15 is lowered below the predetermined value, the passage of the compressed air may be shut off by the solenoid valve and thus the supply of the compressed air is stopped, thereby notifying the user of the fact that the internal pressure of the tank 15 is lowered. Accordingly, since it is possible to prevent painting from being performed in a state where the pressure is lowered, failure such as uneven painting can be prevented in advance.

When the pressure is lowered to a certain level (a first level), the notification is performed as described above, and when the pressure is lowered further than the first level and is lowered up to a second level, the supply of the compressed air to the air outlet may be shut off.

An external communication terminal (such as a cellular phone and a smartphone) may be linked with the air compressor 10, and a signal may be transmitted to the communication terminal when the pressure is lowered, and the communication terminal may be used to notify that the pressure is lowered. According to the above-described notification method, information can be surely acquired even though the user works at a place away from the air compressor 10.

According to an aspect of the present invention, there is provided an air compressor comprising: a motor; a compression mechanism that is driven by the motor and that is configured to generate compressed air; a tank that is configured to store the generated compressed air; a load acquisition part that is configured to acquire a load applied to the compression mechanism; and a control part that is configured to control a rotation of the motor, wherein the control part is configured to perform control for changing a TN characteristic of the motor in response to the load of the compression mechanism acquired by the load acquisition part.

According to the above invention, the control part performs control to change the TN characteristic of the motor in response to the load of the compression mechanism acquired by the load acquisition part. According to such control, since the number of rotations of the motor can be increased in accordance with the load of the compression mechanism, a discharge amount of the compressed air can be increased even in the case of a small motor-driven air compressor.

That is, in a motor-driven air compressor of a related art, since the TN characteristic of the motor is determined, there is a limit to increasing the number of rotations. In consideration of the above-described circumstance, according to the present invention, since the TN characteristic of the motor is changed in response to a driving load of the air compressor (in response to torque), it is possible to increase the number of rotations of the motor beyond a characteristic of an original motor.

As described above, it is possible to increase the number of rotations of the motor at the time of a low load, thereby increasing the discharge amount of the compressed air. For example, when the spray gun is connected to the air compressor and used, an internal pressure of the tank is lowered when the remaining compressed air decreases. In the present invention, when the internal pressure of the tank is lowered in this way, since the TN characteristic of the motor is changed in accordance with the lowness of the internal pressure thereof, the filling time can be shortened by increasing the number of rotations of the motor and by increasing the discharge amount of the compressed air. When the compressed air is filled and the internal pressure of the tank increases, the TN characteristic of the motor is restored (restored to an original characteristic) in accordance with the increase of the internal pressure thereof, thereby making it possible for the motor to be driven with optimum efficiency. Therefore, when the internal pressure of the tank is low and the load is low, the number of rotations is increased to improve the discharge amount, and when the internal pressure of the tank is high and the load is high, the performance can be maintained by efficiently driving the motor.

What is claimed is:

1. An air compressor comprising:

a motor;

a compression mechanism that is driven by the motor and that is configured to generate compressed air;

a tank that is configured to store the generated compressed air;

a load acquisition part that is configured to acquire a load applied to the compression mechanism; and a control part that is configured to control a rotation of the motor, wherein the control part is configured to:

perform control for changing a TN characteristic of the motor in response to the load of the compression mechanism acquired by the load acquisition part, change the TN characteristic of the motor by field weakening control to produce a changed TN characteristic of the motor, execute the control for changing the TN characteristic, periodically, execute a process of setting a target number of rotations of the motor, periodically, and increase, according to the changed TN characteristic of the motor by the field weakening control, the target number of rotations such that the motor is stabilized at a fixed number of rotations.

2. The air compressor according to claim 1, wherein the control part performs control by switching between a normal mode and a following mode, the normal mode in which the TN characteristic of the motor is kept constant regardless of the load of the compression mechanism acquired by the load acquisition part, the following mode in which the TN characteristic of the motor is changed in response to an internal pressure of the tank.

3. The air compressor according to claim 1, wherein the load acquisition part is a tank internal pressure acquisition part that is configured to acquire an internal pressure of the tank.

4. The air compressor according to claim 3, wherein the tank internal pressure acquisition part is a pressure sensor.

5. The air compressor according to claim 1, wherein the load acquisition part is a motor load detection part that is configured to detect a load of the motor, and the control part is configured to estimate an internal pressure of the tank from a detection value of the motor load detection part, and is configured to perform control for changing the TN characteristic of the motor in response to the estimated internal pressure of the tank.

6. The air compressor according to claim 5, wherein the motor load detection part includes a current sensor that is configured to detect a current value of the motor.

7. The air compressor according to claim 6, wherein the control part is configured to gradually strengthen field weakening control as the current value of the current sensor increases.

8. The air compressor according to claim 7, wherein the control part is configured to execute the field weakening control until the current value of the current sensor reaches an upper limit value of a current that can be supplied to the air compressor.

9. The air compressor according to claim 1, wherein a periodic cycle of the control for changing the TN characteristic is shorter than a periodic cycle of the process of setting the target number of rotations of the motor.

10. The air compressor according to claim 1, wherein the fixed number of rotations is an upper limit on a number of rotations of the motor.

* * * * *